US006082532A

United States Patent [19]

Miess

[11] Patent Number: 6,082,532

[45] Date of Patent: Jul. 4, 2000

[54] BOTTLE CARRIER

[76] Inventor: Kenneth R. Miess, 4600 Eagle Dr., Apt. 307, Elk Grove Village, Ill. 60007

[21] Appl. No.: 09/249,544

[22] Filed: Feb. 12, 1999

[51] Int. Cl.[7] ..... B65D 71/44

[52] U.S. Cl. ..... 206/158; 206/199

[58] Field of Search ..... 206/145, 147–149, 206/151, 158, 162, 197, 199, 427; 294/87.2

[56] References Cited

U.S. PATENT DOCUMENTS

| | | | |
|---|---|---|---|
| 2,397,716 | 4/1946 | Wendler | 294/87 |
| 2,737,326 | 3/1956 | Toensmeier | 224/45 |
| 2,950,041 | 8/1960 | Stone | 229/40 |
| 3,073,644 | 1/1963 | Baker et al. | 294/87.2 |
| 3,156,358 | 11/1964 | Randrup | 206/65 |
| 3,711,143 | 1/1973 | Smed | 206/158 |
| 3,784,246 | 1/1974 | Klygis | 294/87.2 |
| 3,860,281 | 1/1975 | Wood | 294/87.2 |
| 3,897,873 | 8/1975 | Graser | 206/153 |
| 4,372,599 | 2/1983 | Kiedaisch et al. | 294/87.2 |
| 4,621,734 | 11/1986 | Heijnen et al. | 206/427 |
| 4,736,977 | 4/1988 | Killy | 294/87.2 |
| 5,267,644 | 12/1993 | Tsao | 206/151 |
| 5,344,006 | 9/1994 | Mazzeo | 206/153 |
| 5,484,053 | 1/1996 | Harris | 206/147 |
| 5,682,982 | 11/1997 | Stonehouse | 206/142 |
| 5,706,936 | 1/1998 | Bernstein | 206/147 |
| 5,711,419 | 1/1998 | Beales et al. | 206/147 |
| 5,816,391 | 10/1998 | Harris | 206/147 |

FOREIGN PATENT DOCUMENTS

| | | |
|---|---|---|
| 1.418.015 | 11/1965 | France . |
| 2 271 097 | 6/1994 | United Kingdom . |

*Primary Examiner*—Jim Foster

*Attorney, Agent, or Firm*—Marshall, O'Toole, Gerstein, Murray & Borun

[57] ABSTRACT

A blank for carrying bottles with an engaging edge has a center panel, a pair of securing panels, a pair of handle panels, an exterior grip support panel and an interior grip support panel. The center panel has a plurality of apertures formed therein. The securing panels have apertures formed therein to match the number of apertures in the center panel. The securing panels also have individual flaps formed in association therewith therein and aligned substantially perpendicular to the handle. When the blank is folded and formed into a carrier, the apertures of the center panel and the apertures and individual flaps of the securing panel create a corresponding number of bottle receiving collars. Consequently, when bottles are placed into the carrier, each bottle receiving collar engages the engaging edge of each bottle and supports each bottle during transport.

20 Claims, 7 Drawing Sheets

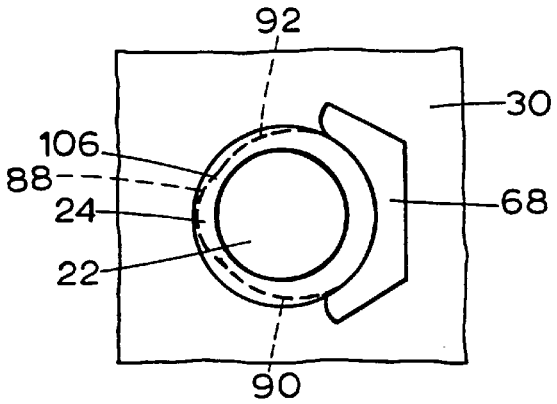
FIG. 14
FIG. 15
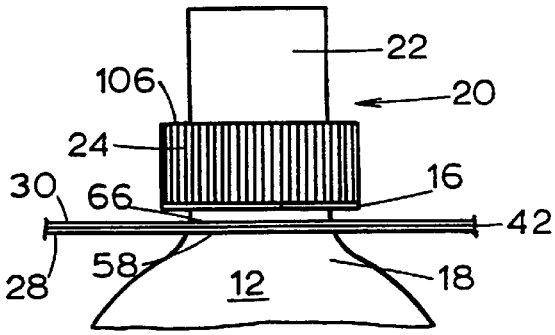
FIG. 16
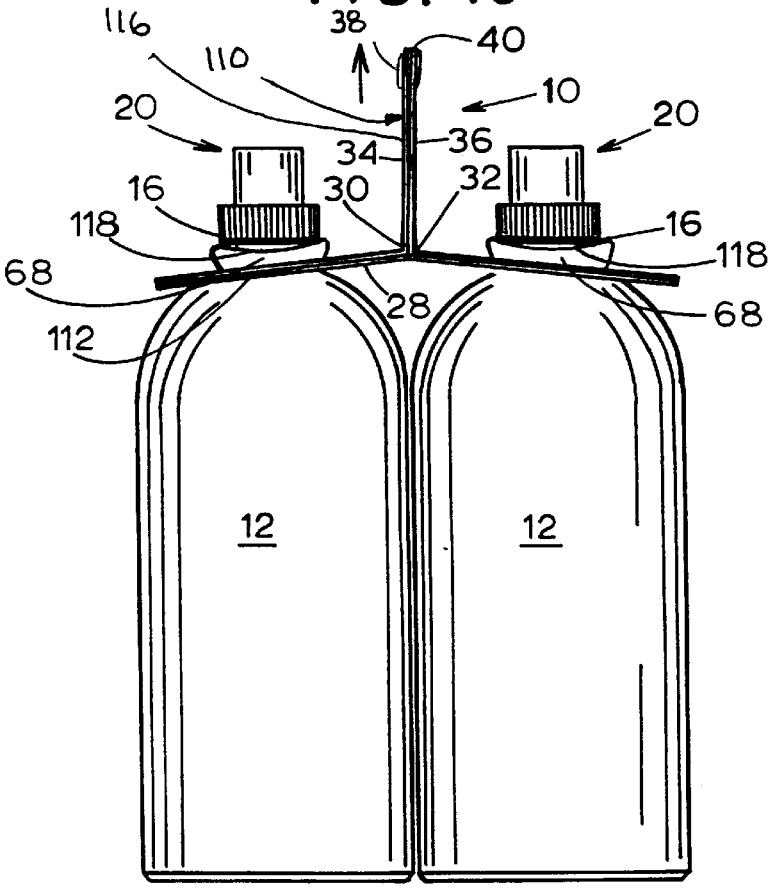

BOTTLE CARRIER

TECHNICAL FIELD

The present invention relates generally to bottle carriers and more particularly to paperboard carriers for holding bottles having an engaging lip or edge.

BACKGROUND ART

Prior paperboard bottle carriers have suffered from a number of shortcomings. Many carriers were too weak structurally to support the weight of the bottles, which resulted in the bottles becoming disengaged from the carrier. Other carriers that were stronger structurally were too complex to assemble limiting use of automated machinery in the manufacturing or bottling/packaging facility.

Many of these early paperboard bottle carriers utilized a series of radial cuts or sunburst apertures in the paperboard to hold the bottles. The radial cut-type securing devices were often unreliable because some bottles can be too heavy to be supported by the radially cut paperboard and these bottles would not be retained in the apertures and fall out of the carrier. This was especially true when the carrier had been stored for a long time. In storage, the carrier would settle over the shoulder of the bottle. The shoulder would then push upward against the radial cuts, particularly when the carriers were stacked, causing the paperboard near the radial cuts to develop a permanent upward bend. As result of the permanent upward bend, when the carrier was lifted after storage the radial cuts would fail to engage the bottles, which would then fall out of the carrier.

A significant improvement over these prior paperboard bottle carriers is provided by the invention set forth in commonly-assigned U.S. Pat. No. 5,682,982, the disclosure of which is hereby expressly incorporated herein by reference. As described in the '982 patent, a bottle is retained within the bottle carrier through the cooperation of a flap with apertures formed in a top panel and a bottom panel to engage the bottle in a direction transverse to the carrier handle and to thus retain the bottles within the carrier.

Still, it has been observed that further improvement in paperboard bottle carriers may be made.

SUMMARY OF THE INVENTION

One aspect of the present invention provides a blank for forming a carrier for carrying a plurality of bottles, where each bottle has an engaging edge with a diameter. The blank has a plurality of panels connected to each other. A center panel has a plurality apertures formed therein and the center panel also has a pair of opposing edges aligned with a first direction. A pair of securing panels is connected to the opposing edges of the center panel. A plurality of apertures are formed in the securing panels and a single flap is formed in association with each aperture. The flaps are arranged substantially perpendicular to the first direction and such that in a bottle carrying position, the association of the aperture with the individual flap defines a diameter less than the diameter of the engaging edge of the bottle. A pair of handle panels is connected to the pair of securing panels with the pair of handles being aligned with the first direction.

The center panel may include a plurality of access lips, where each aperture of the center panel is associated with an access lip. Each access lip may include an arcuate cut-out portion that extends from an edge of the associated aperture of the center panel. Furthermore, the access lip may be disposed such that when the securing panels are folded over the center panel, a plurality of bottle receiving collars are formed, with each collar having a flap on a side opposite the access lip.

The access lips may be disposed on a common side of each aperture and aligned to facilitate engagement of the bottle carrier with bottles through movement of the carrier in a single direction with respect to the bottles.

Each individual flap may include a curved lip and a hinge, and the individual flap may be generally U-shaped. The hinge of the individual flap is substantially perpendicular to the first direction, and the hinge is disposed perpendicular to the first direction.

Each aperture of the securing panel may be defined by the curved lip of the individual flap, an access lip opposite the curved lip and a pair of main support lips disposed between the curved lip and the access lip.

Each handle panel may have a handle opening, and at least one of the handle openings may have an edge. The blank may include an exterior grip support panel connected to the edge of the at least one handle opening. The blank may include an interior grip support panel connected to an outer edge of one of the handle panels.

In accordance with another embodiment of the present invention, a bottle carrier carries a plurality of bottles, where each bottle has an engaging edge with a diameter. A bottle carrying portion includes a top panel connected to a bottom panel. A plurality of apertures are formed in the top panel and a single flap is formed in association with each aperture. A plurality of apertures are formed in the bottom panel. The apertures and individual flaps of the top panel and the apertures of the bottom panel form a plurality of bottle receiving collars. A handle is attached to and extends from the bottle carrying portion and each of the flaps are substantially orthogonal to the handle.

Another aspect of the present invention is a method for forming a carrier for carrying a plurality of bottles, where each bottle has an engaging edge with a diameter. The method includes creating a blank having a center panel with a plurality of apertures formed therein, and a pair of securing panels having formed therein a plurality of apertures and each aperture having s single flap formed in association therewith. The method further includes placing the bottles into the apertures of the center panel; pushing the center panel downward until the center panel is below the engaging edge of the bottle; placing the bottles into the apertures of the securing panels; pushing the securing panels downward until the securing panels and the individual flaps are beneath the engaging edge of each bottle; and adhering the securing panels to the center panel.

In another aspect of the present invention, a bottle carrier is assembled in accordance with the preferred embodiments of the invention but apart from the bottles to be carried. A plurality of bottles are then gathered, and secured within the receiving collars.

Other features and advantages are inherent in the blank and the carrier of the present invention or will become apparent to those skilled in the art from the following detailed description in conjunction with the accompanying drawings.

BRIEF DESCRIPTION OF THE DRAWINGS

FIG. 14 is a partial top plan view of the securing panel of FIG. 12 with the flap disposed beneath the bottle cap;

FIG. 15 is a side elevation view of FIG. 14; and

FIG. 16 is a side elevation view of a bottle carrier of the present invention retaining a plurality of bottles.

DESCRIPTION OF THE PREFERRED EMBODIMENT

Figure 1:
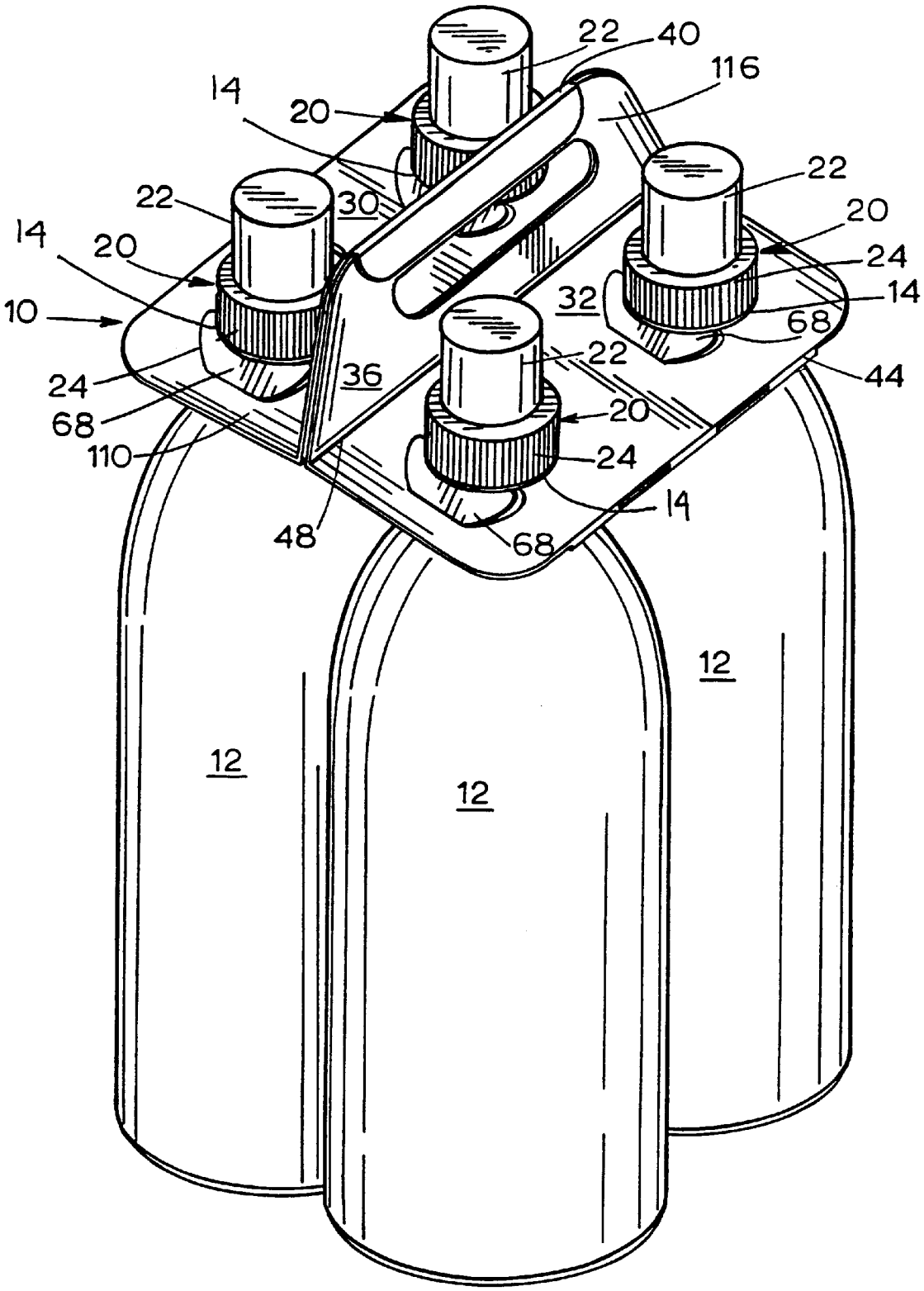
FIG. 1 is a perspective view of a bottle carrier of the present invention.
Figure 2:
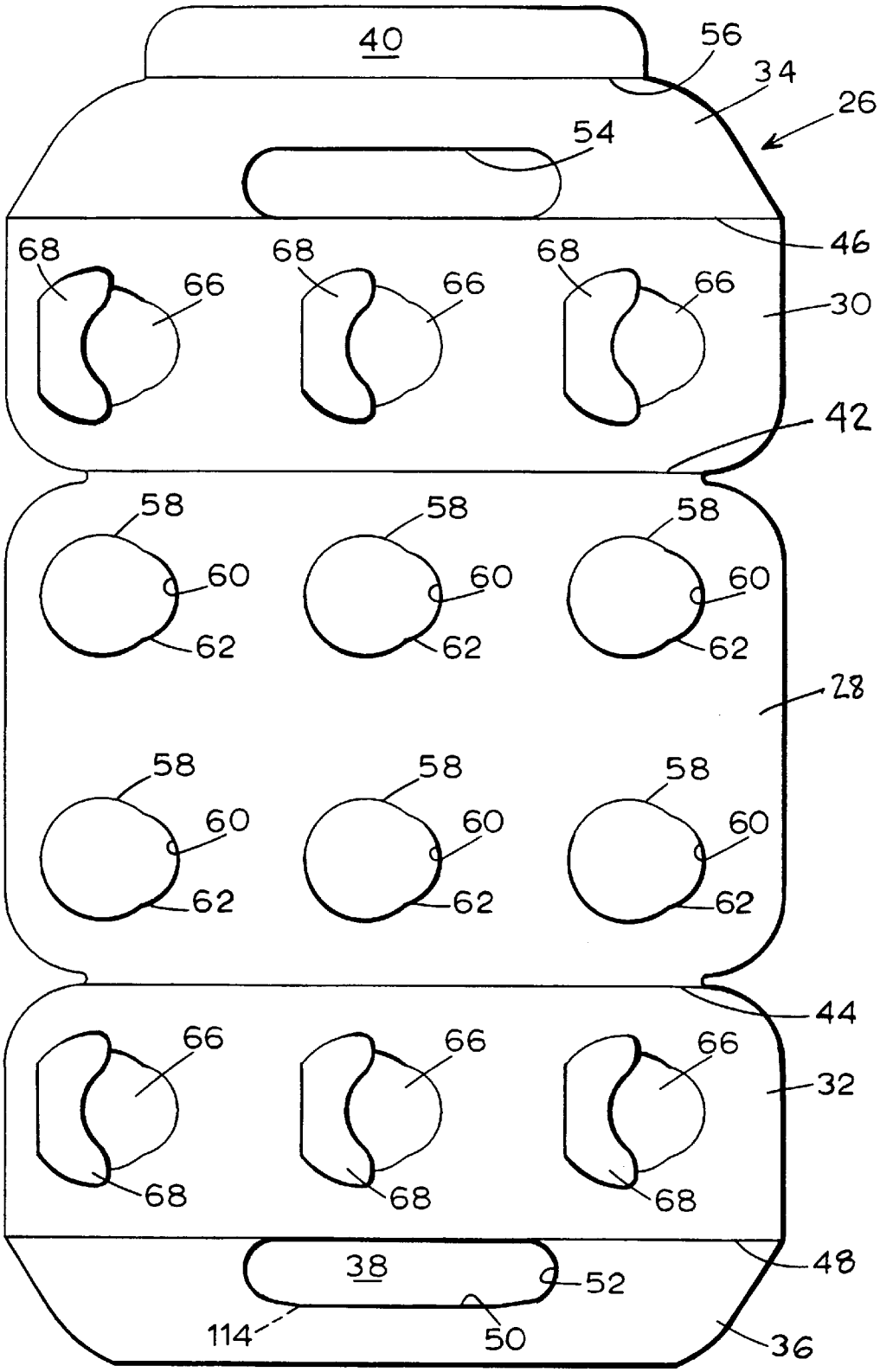
FIG. 2 is a top plan view of a blank for a bottle carrier in accordance with the present invention.

Illustrated in FIG. 1 is a bottle carrier 10 in a formed condition holding four bottles 12. Though four bottles are illustrated, any number of bottles could be used, and for example, FIG. 2 illustrates a blank for forming a bottle carrier for carrying six bottles. Bottles 12 may be of virtually any configuration providing each includes some form of an engaging edge 14. Several different engaging edges for bottles 12 are illustrated and described in the above-mentioned '982 patent. As illustrated in FIG. 1, engaging edge 14 is defined by a cap 20 of the bottle 12. The cap 20 may include a top portion 22 and a bottom portion 24 that may be wider than the top portion 22. However, engaging edge 14 may be an annular lip formed as an integral portion of bottle 12.

Figure 3:
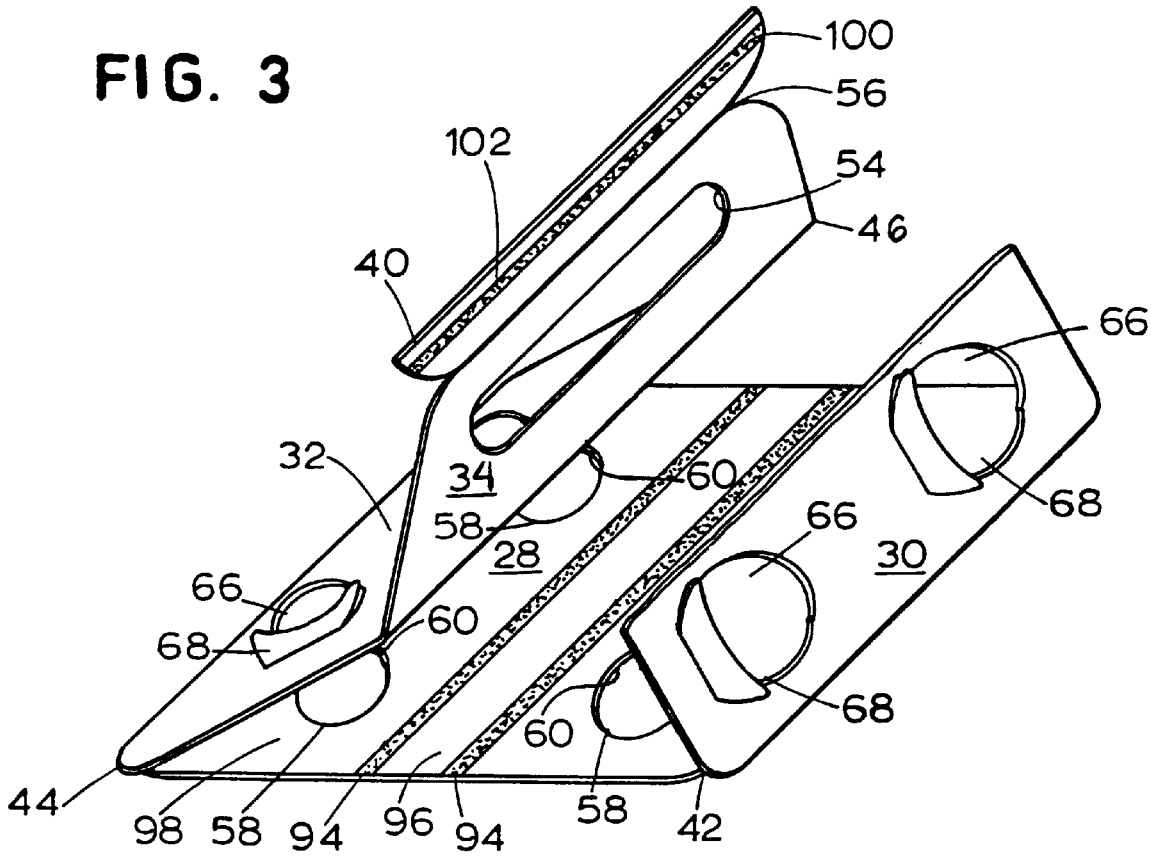
FIG. 3 is a perspective view of a partially assembled bottle carrier of the present invention.

The bottle carrier 10 is preferably formed from a blank 26, shown in FIG. 2. The blank 26 may be made from a paperboard material approximately 0.50 mm thick or from any other material conventionally used in carton formation. The blank 26 includes a center panel 28, a pair of securing panels 30 and 32, a pair of handle panels 34 and 36, an exterior grip support panel 38 and an interior grip support panel 40. The center panel 28 is hingedly connected to the securing panels 30, 32 by fold lines 42, 44, respectively. The fold lines are preferably defined by pressing, scoring or some other line-forming process. The securing panels 30, 32 are hingedly connected to the handle panels 34, 36 by fold lines 46, 48, respectively. The exterior grip support panel 38 is hingedly connected to the handle panel 36 by a fold line 50 and is positioned in a handle opening 52, formed in the handle panel 36. The handle panel 34 has a similar handle opening 54 formed therein. The interior grip support panel 40 is hingedly connected to the handle panel 34 by a fold line 56. By folding the blank 26 along the previously described fold lines, as illustrated in FIG. 3, the bottle carrier 10 is formed.

Referring again to FIG. 2, six apertures 58 are formed in the center panel 28. Although six apertures 58 are shown in the embodiment of FIG. 2, any number of apertures could be used, such as four apertures shown in FIG. 1 and FIG. 3. Also formed in the center panel 28 are six access lips 60, one for each aperture 58 of the center panel 28. Each access lip 60 is preferably an arcuate cut-out of smaller diameter than aperture 58 formed on a same side 62 of each aperture 58 and aligned substantially perpendicular to fold lines 42 and 44 of center panel 28.

Figure 2A:
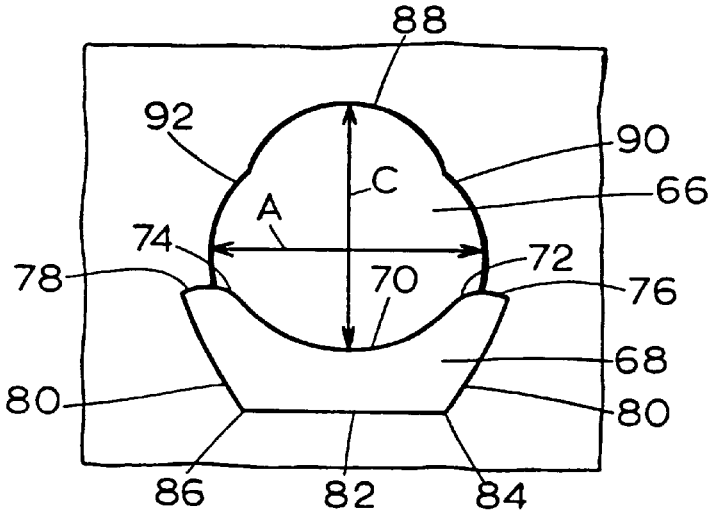
FIG. 2A is an enlarged view of a portion of the blank of FIG. 2.

The securing panels 30, 32 have apertures 66 formed therein. The total number of apertures 66 in the securing panels 30, 32 is equal to the total number of apertures 58 formed in the center panel 28. Six, generally U-shaped, flaps 68 are also formed in the securing panels 30, 32 so that a single flap 68 is associated with each aperture 66. FIG. 2A illustrates the aperture 66 and the flap 68 in greater detail. Each flap 68 includes a curved lip 70 having opposite ends 72, 74, a pair of curved edges 76, 78, a pair of sides 80 and a hinge 82 having opposite ends 84, 86. The hinge 82 of each flap 68 may be defined by a score in the paperboard material and is disposed substantially perpendicular to fold lines 42 and 44 (FIG. 2). The sides 80 of each flap 68 may be defined by cuts through the paperboard material. The sides 80 start on opposite ends 84, 86 of the hinge 82 and extend outward, in the direction of the aperture 66, until the sides 80 curve to form the curved edges 76, 78. The curved edges 76, 78 connect to opposite ends 72, 74 of the curved lip 70.

Figure 5:
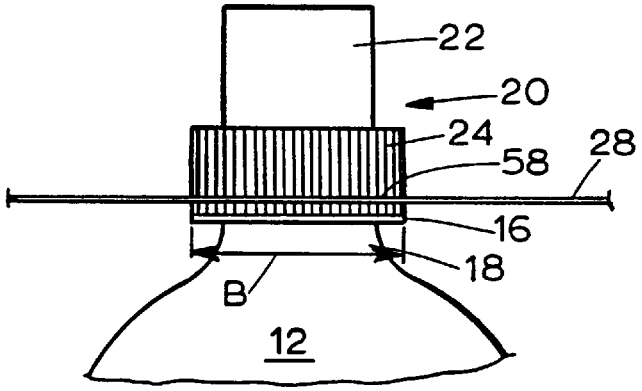
FIG. 5 is a side elevational view of FIG. 4.

Each aperture 66 of the securing panels 30, 32 is defined by three portions: an access lip 88, a pair of main support lips 90, 92 and the curved lip 70 of the flap 68. The main support lips 90, 92 define a diameter A of the aperture 66. The diameter A is approximately the same as a diameter B of the annular lip 16 of each bottle 12 (FIG. 5). The curved lip 70 has a larger radius of curvature than the main support lips 90, 92. The access lip 88 has a smaller radius of curvature than the main support lips 90, 92. The curved lip 70 and the access lip 88 define a diameter C, or engaging axis, across the aperture 66 which is less than the diameter B of the annular lip 16 of each bottle 12 (FIG. 5). Diameter C is substantially aligned with fold lines 42 and 44.

FIG. 3 illustrates the steps for forming the bottle carrier 10 without the bottles 12. In practice, the bottle carrier 10 may be formed around the bottles 12 either by hand or by automated machinery. Bottle carrier 10 may also be formed, either by hand or machinery apart from the bottles 12, and the bottles 12 later secured therein. FIG. 3 is assist in understanding the present invention by clearly illustrating the relative positions of the components of the bottle carrier 10. To form the bottle carrier 10 without the bottles 12, a pair of layers of adhesive 94 are applied along the length of a middle 96 of a top surface 98 of the center panel 28 and a single layer of adhesive 100 is applied along a top surface 102 of the interior grip support panel 40. Next, the securing panels 30, 32 are folded along the fold lines 42, 44; the handle panels 34, 36 (handle panel 36 has been omitted from FIG. 3 for clarity) are folded along the fold lines 46, 48 and the interior grip support panel 40 is folded along the fold line 56 until the interior grip support panel 40 and the layer of adhesive 100 are brought into contact with the handle panel 36, adhering the interior grip support panel 40 to the handle panel 36. The securing panels 30, 32, are then folded inward toward the middle 96 of the center panel 28 until the securing panels 30, 32 contact the pair of layers of adhesive 94 and the handle panels 34, 36 abut one another. The blank 26, as illustrated, is constructed from a single piece of paperboard. However, the center panel 28, the securing panels 30, 32 and the handle panels 34, 36 could all be separate pieces or any combination of separate pieces and attached to one another using additional adhesive.

Figure 4:
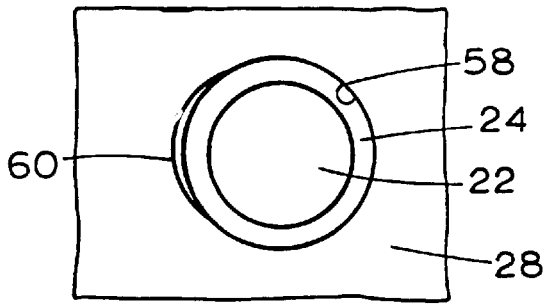
FIG. 4 is a partial top plan view of the center panel of the blank of FIG. 2 engaged with a cap of a bottle.
Figure 6:
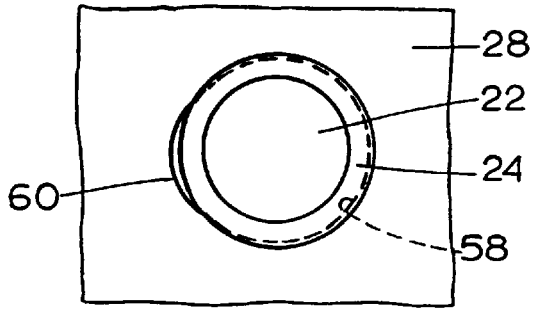
FIG. 6 is a partial top plan view of the center panel of FIG. 4 with the center panel disposed beneath the bottle cap.
Figure 7:
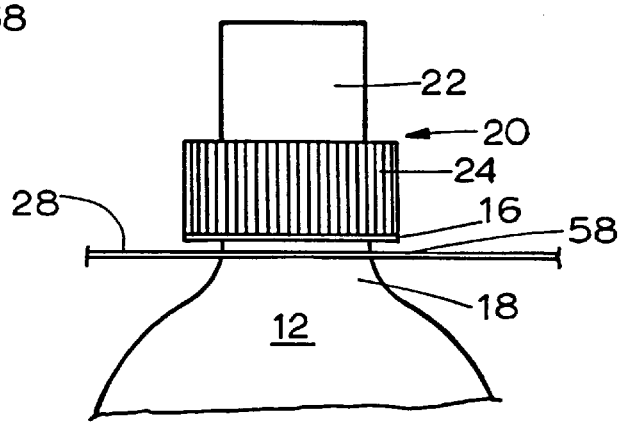
FIG. 7 is a side elevation view of FIG. 6.

FIGS. 4–15 illustrate the steps for forming the bottle carrier 10 with the bottles 12. As seen in FIGS. 4–7, the center panel 28 is pressed down over the bottom portion 24 of the cap 20 and the annular lip 16 of the bottles 12. The aperture 58 is approximately the same diameter as the diameter of the bottom portion 24 of the cap 20 and the annular lip 16 of the bottle 12. Therefore, lining up and pressing the aperture 58 over the bottom portion 24 and the annular lip 16 would require a machine (not shown) of great precision to perfectly form the bottle carrier 10 every time in mass operation. The access lip 60, however, facilitates that process by providing additional space for cap 20 to pass through aperture 58 as center panel 28 is positioned over the bottles 12 (FIGS. 4–5). Furthermore, each access lip 60 is formed on a common side of apertures 58. Thus, translation of center panel 28 with respect to the bottles 12 in a single direction substantially parallel to fold lines 42 and 44 facilitates capturing top portion 22 and guiding bottom portion 24 through apertures 58. As illustrated in FIGS. 6 and 7, once the center panel 28 is pushed below the annular lip 16, substantially all of aperture 58 extends below annular lip 16 and helps secure the center panel 28 below the annular lip 16.

Figure 8:
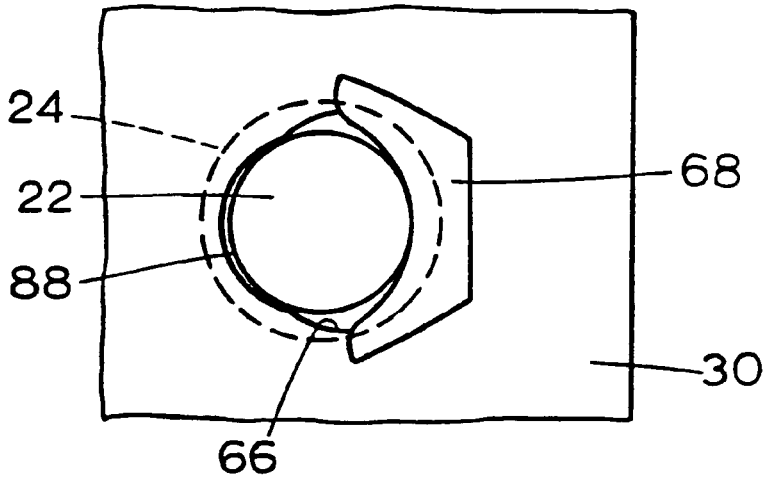
FIG. 8 is a partial top plan view of a securing panel of the blank of FIG. 2 being folded over the top of the bottle cap.
Figure 9:
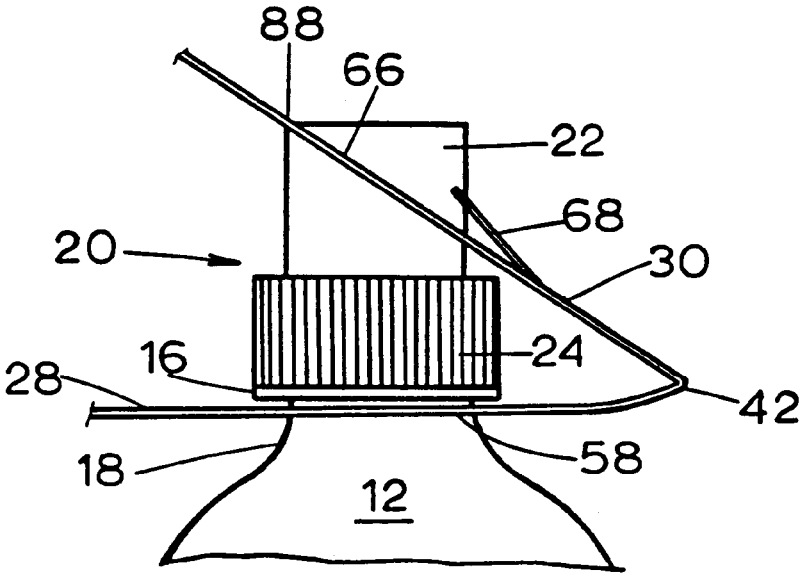
FIG. 9 is a side elevation view of FIG. 8.
Figure 10:
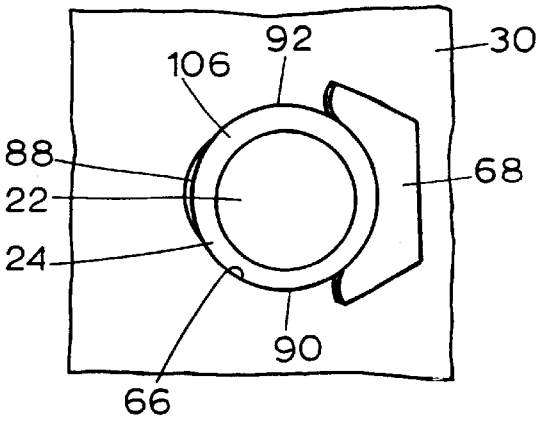
FIG. 10 is a partial top plan view of the securing panel of FIG. 8 with the securing panel disposed beneath the bottle cap.
Figure 11:
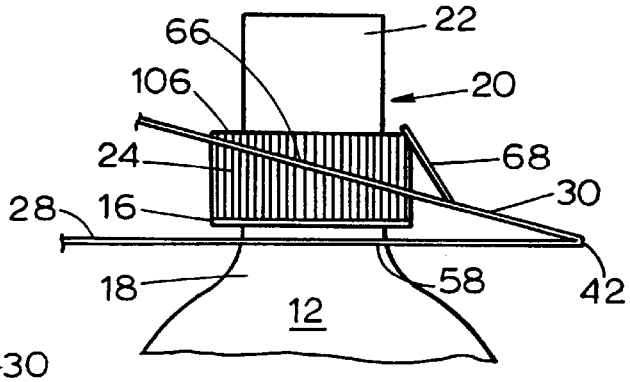
FIG. 11 is a side elevation view of FIG. 10.
Figure 12:
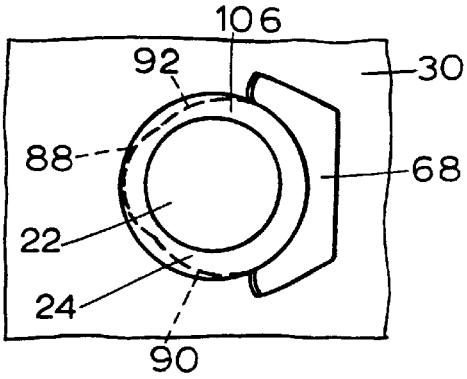
FIG. 12 is a partial top plan view of the securing panel of FIG. 10 with the securing panel being further disposed beneath the bottle cap.
Figure 13:
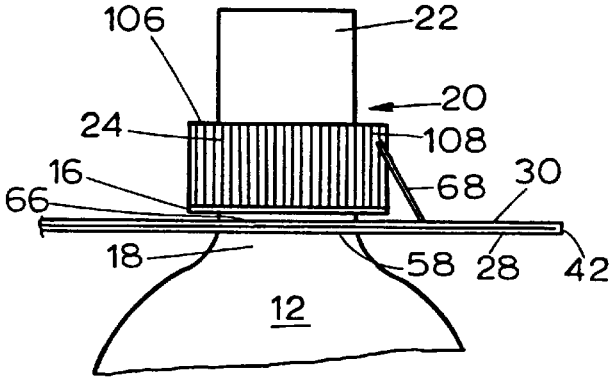
FIG. 13 is a side elevation view of FIG. 12.

The next step is folding the securing panels 30, 32 inward toward the caps 20 along the fold lines 42, 44 and folding the handle panels 34, 36 along the fold lines 46, 48 (FIG. 3). As shown in FIGS. 8–15, the securing panels 30, 32 are pressed down over the bottom portion 24 of the cap 20, in a manner similar to the center panel 28 being pressed down over the caps 20. The access lips 88 allow each securing panel 30, 32 to fit over the top portion 22 of the cap 20, as shown in FIGS. 8 and 9. Again, formation of the access lips 88 on a common side of apertures 66 facilitates capturing the top portion 22 and guiding bottom portion 24 through apertures 66 through movement of blank 26 in a single direction substantially parallel to fold lines 42 and 44. Next, as illustrated in FIGS. 10 and 11, each securing panel 30, 32 continues to be pushed downward over the bottom portion 24 of the cap 20. As each securing panel 30, 32 comes in contact with the bottom portion 24, the main support lips 90, 92 develop a snug fit with the bottom portion 24 of the cap 20. Simultaneously, the flap 68 comes in contact with a top surface 106 of the bottom portion 24 of the cap 20 and is pushed upward. Each securing panel 30, 32 continues on a downward path until each securing panel 30, 32 is pushed below the annular lip 16 of the bottle 12, and brought in contact with the layer of adhesive 94 on the center panel 28 (FIG. 3). During this phase, the flap 68 remains in an upward position and runs along an outside 108 of the bottom portion 24 of the cap 20, as illustrated in FIGS. 12 and 13. Finally, as illustrated in FIGS. 14 and 15, the flap 68 is pulled underneath the annular lip 16 of the bottle 12 by the continued downward movement of each securing panel 30, 32.

In the preferred embodiments shown, each access lip 60 substantially aligns with a corresponding access lip 88. As described, this arrangement facilitates assembly of carrier 10 over bottles 12 in that movement of either carrier 10 with respect to bottles 12 or vice-versa need only occur in a single linear direction for capturing caps 20 and securing them through their respective apertures. Once the carrier 10 is assembled over bottles 12, the flap 68 and the access lips 60 and 88 define the diameter C illustrated in FIG. 2A. The diameter C is less than the diameter B of the engaging edge 14 of the bottle 12 and allows the carrier 10 to support the bottles 12 in a bottle carrying position. Additionally, when the securing panels 30, 32 are folded over the center panel 28, the apertures 58 of the center panel 28 and the apertures 66 and the flaps 68 of the securing panels 30, 32 create a plurality of bottle receiving collars 112. The access lip 60 and the access lip 88 are disposed in opposition to the flap 68 of each collar 112. When bottles 12 are positioned within carrier 10 they are urged toward the arcuate formation formed by the cooperation of access lip 60 and access lip 88 by flap 68. This ensures, as best seen in FIG. 14, that main support lips 90 and 92 are brought into and maintain engagement with annular lip 16 for supporting bottle 12 within carrier 10.

Lastly, a handle 110 is formed. FIGS. 1, 3 and 16 illustrate the formation of the handle 110. At this point, the handle panels 34, 36 have already been folded, and as a result of the previously described steps, the handle panels 34, 36 now abut each other and extend upward (as viewed in FIG. 16) from the center panel 28. The handle panels 34, 36, when combined in the manner described, define the handle 110.

When the bottle carrier 10 is picked up for the first time, the exterior grip support panel 38 will be pushed inward causing the exterior grip support panel 38 to separate from a perforated edge 114 (FIG. 2) of the handle opening 52 and fold along the fold line 50. As the exterior grip support panel 38 continues to be folded inward along the fold line 50, the exterior grip support panel 38 makes contact with an outer surface 116 of the handle panel 34. In the configuration described, as illustrated in FIG. 16, the exterior grip support panel 38 provides additional support to the handle 110 of the bottle carrier 10.

When the bottle carrier 10 is lifted by the handle 110, as shown by the arrow in FIG. 16, the flap 68 engages a bottom surface 118 of the engaging edge 14 of the bottle 12. The size and shape of the flap 68, combined with the support the center panel 28 provides underneath the flap 68, to keep the bottle 12 secure during transport and to prevent the bottle 12 from falling out of the carrier 10.

Moreover, when packaged bottles are stacked, downward pressure on handle 38 will not result in flap 68 being pushed outwardly and away from engaging edge 14. Such movement of the flap 68 may result in flap 68 becoming disengaged from engaging edge 14, and hence, bottle 12 coming disengaged from carrier 10. Alignment of the flap 68 substantially perpendicular to the handle 38 prevents such movement and therefore ensures that the flap 68 will remain engaged with engaging edge 14 and thus bottle 12 will remain secured within carrier 10.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. A blank for forming a carrier for carrying a plurality of bottles, wherein each bottle has an engaging edge with a diameter, comprising:

a center panel having a plurality of apertures formed therein;

a pair of opposing edges on the center panel aligned in a first direction;

a pair of securing panels connected to the opposing edges of the center panel;

a plurality of apertures formed in the securing panels, each aperture formed with only one, single flap member such that, in a bottle carrying position, the association of the aperture with the one, single flap member defines a diameter less than the diameter of the engaging edge of the bottle;

each flap member pivotably secured to the securing panel along a first edge, the first edge being aligned substantially perpendicular to the first direction; and a pair of handles panels connected to the pair of securing panels and substantially aligned with the first direction.

2. The blank of claim 1, wherein each of the plurality of center panel apertures and each of the plurality of securing panel apertures are formed with an arcuate cut-out, and in the bottle carrying position, each of the plurality of center panel apertures align with a respective one of the plurality of center panel apertures such that the respective arcuate cut-outs substantially align.

3. The blank of claim 2, wherein each of the arcuate cut-outs formed in the plurality of securing panel apertures are arranged in opposition to the flap member respectively formed in the securing panel aperture.

4. The blank of claim 1, further comprising a hinge securing each flap member to the securing panel, the hinge having a hinge axis, and the hinge axis being substantially perpendicular to the first direction.

5. The blank of claim 1, each flap member comprising an arcuate second edge defining in association with the respective aperture a diameter less than the diameter of the engaging edge.

6. The blank of claim 5, wherein the diameter has an axis of engagement substantially parallel to the first direction.

7. The blank of claim 5, wherein the diameter has an axis of engagement and wherein each axis of engagement is substantially parallel to each other axis of engagement.

8. The blank of claim 1, wherein each flap member is formed on a corresponding same side of each aperture.

9. The blank of claim 1, each flap member comprising an arcuate portion that extends from the first edge into the respective aperture.

10. A carrier for carrying a plurality of bottles, wherein each bottle has an engaging edge with a diameter, comprising:

a bottle carrying portion including a top panel connected to a bottom panel;

a plurality of apertures formed in the top panel, the plurality of apertures aligned with a first direction, only one, single flap associated with each of the plurality of apertures, each one, single flap being aligned substantially perpendicular to the first direction;

a plurality of apertures formed in the bottom panel, one of the plurality of apertures in register with one of the plurality of apertures formed in the top panel;

wherein each one, single flap cooperates with its respective one of the plurality of apertures formed in the top panel and the corresponding one of the plurality of apertures formed in the bottom panel to form a bottle retaining collar; and a handle attached to and extending from the bottle carrying portion and aligned with the first direction.

11. The carrier of claim 10, wherein each of the plurality of top panel apertures and each of the plurality of bottom panel apertures are formed within an arcuate cut-out and each of the plurality of top panel apertures align with a respective one of the plurality of bottom panel apertures such that the respective arcuate cut-outs substantially align.

12. The carrier of claim 11, wherein each of the arcuate cut-outs are arranged in opposition to the flap member respectively formed in the associated.

13. The carrier of claim 10, further comprising a hinge securing each flap member to the securing panel, the hinge having a hinge axis, and the hinge axis being substantially perpendicular to the first direction.

14. The carrier of claim 10, each flap member comprising an arcuate second edge defining in association with the respective aperture a diameter less than the diameter of the engaging edge.

15. The carrier of claim 14, wherein the diameter has an axis of engagement substantially parallel to the first direction.

16. The carrier of claim 14, wherein the diameter has an axis of engagement and wherein each axis of engagement is substantially parallel to each other axis of engagement.

17. The carrier of claim 10 wherein each flap member is formed on a corresponding same side of each aperture.

18. The carrier of claim 9, each flap member comprising an arcuate portion that extends from the first edge into the respective aperture.

19. A method for forming a carrier for carrying a plurality of bottles, the method comprising the steps of:

creating a blank comprising a center panel having a pair of opposing edges aligned in a first direction and a plurality of apertures formed therein, a pair of securing panels connect to the opposing edges, a plurality of apertures formed in each of the securing panels, each aperture formed in the securing panel having only one, single flap member formed in the securing panel, and each only one, single flap member having a pivot axis aligned substantially perpendicular to the first direction;

gathering a plurality of bottles, each bottle having an engaging edge with a diameter;

placing the bottles into the apertures of the center panel such that each aperture is disposed below the engaging edge;

placing the bottles into the apertures of the securing panels;

pushing the securing panels to displace the flap members and continuing until the securing panels and flap members are disposed beneath the engaging edge of each of the bottles such that the respective one, single flap member and the associated aperture form a bottle receiving collar; and adhering the securing panels to the center panel.

20. A method for forming a carrier for carrying a plurality of bottles, the method comprising the steps of:

creating a blank comprising a center panel having a pair of opposing edges aligned in a first direction and a plurality of apertures formed therein, a pair of securing panels connect to the opposing edges, a plurality of apertures formed in each of the securing panels, each aperture formed in the securing panel having one, single flap member formed in the securing panel, and each one, single flap member having a pivot axis aligned substantially perpendicular to the first direction, wherein a respective aperture in the center panel aligns with a respective aperture of one of the securing panels such that the cooperation of the one, single flap member and the aperture define a receiving collar;

adhering the securing panels to the center panel;

forming a handle portion extending substantially perpendicularly form the securing panels, the handle portion being substantially aligned with the first direction and disposed along a center portion of the bottle carrier;

gathering a plurality of bottles, each bottle having an engaging edge with a diameter;

placing one bottle into each of he receiving collars, that the receiving collar is disposed below the engaging edge.

* * * * *